US010701998B2

(12) United States Patent
Fildan et al.

(10) Patent No.: US 10,701,998 B2
(45) Date of Patent: Jul. 7, 2020

(54) FASTENER FOR CLOTHING OR LINGERIE

(71) Applicants: DUBROSKY & TRACY PATENT SERVICE CORP, Hong Kong (CN); Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 341 days.

(21) Appl. No.: 15/570,689

(22) PCT Filed: Apr. 28, 2016

(86) PCT No.: PCT/EP2016/059573
§ 371 (c)(1),
(2) Date: Oct. 30, 2017

(87) PCT Pub. No.: WO2016/174182
PCT Pub. Date: Nov. 3, 2016

(65) Prior Publication Data

US 2018/0140031 A1 May 24, 2018

(30) Foreign Application Priority Data

Apr. 29, 2015 (GB) ..... 1507319.0

(51) Int. Cl.
*A44B 11/25* (2006.01)
*A41F 1/00* (2006.01)
(Continued)

(52) U.S. Cl.
CPC ..... *A41F 1/002* (2013.01); *A41F 1/006* (2013.01); *A41F 1/04* (2013.01); *A45C 13/1069* (2013.01)

(58) Field of Classification Search
CPC . A41F 1/002; A41F 1/006; A41F 1/04; Y10T 24/32
See application file for complete search history.

(56) References Cited

U.S. PATENT DOCUMENTS 6,163,938 A * 12/2000 Weber-Unger ..... A41F 1/002 24/303
6,505,385 B2 * 1/2003 Grunberger ..... A44B 11/2592 24/303

(Continued)

FOREIGN PATENT DOCUMENTS

| | | |
|---|---|---|
| DE | 20018405 | 1/2001 |
| EP | 1488714 A1 | 12/2004 |
| GB | 581096 A | 10/1946 |

*Primary Examiner* — Jason W San
(74) *Attorney, Agent, or Firm* — Kintner IP, LLC; Mary Frances Ludwig

(57) ABSTRACT

This invention relates to a fastener (100, 400, 700, 1000, 1300) for clothing or lingerie. The fastener comprises a front element (200, 500, 800, 1100, 1400) having at least one seat cavity (201) and a back element (300, 600, 900, 1200, 1500) having at least one bump (301) for location in the seat cavity. The front element and back element each comprise magnets (235, 329) to assist in the location of the bump in the seat cavity. The front and back elements additionally comprise a plurality of complementary catch faces (203, 205, 211, 213, 501, 303, 305, 311, 313, 601) which secure the engagement of the front and back elements and are operable to prevent inadvertent release of the back element from the front element when the back element is subjected to forces in any of a plurality of disparate directions.

19 Claims, 13 Drawing Sheets

(51) Int. Cl.
*A41F 1/04* (2006.01)
*A45C 13/10* (2006.01)

(56) References Cited

U.S. PATENT DOCUMENTS

| | | | | |
|---|---|---|---|---|
| 6,606,767 | B2 * | 8/2003 | Wong | A41F 1/006 24/303 |
| 6,622,349 | B2 * | 9/2003 | Wong | A41F 1/006 24/303 |
| 8,359,716 | B2 * | 1/2013 | Fiedler | A44B 11/25 24/303 |
| 8,505,174 | B2 * | 8/2013 | Fildan | A41F 1/002 24/303 |
| 8,935,835 | B2 | 1/2015 | Fildan | |
| 9,101,185 | B1 | 8/2015 | Greenberg | |
| 9,907,367 | B2 * | 3/2018 | Paik | A41F 1/002 |
| 9,907,368 | B2 * | 3/2018 | Paik | A44B 11/266 |
| 9,936,772 | B2 * | 4/2018 | Paik | A44B 11/2592 |
| 10,085,521 | B2 * | 10/2018 | Chen | A41F 1/002 |
| 10,143,270 | B2 * | 12/2018 | Fiedler | A44B 11/2584 |
| 10,499,698 | B2 * | 12/2019 | Fildan | A41F 1/006 |
| 2003/0005558 | A1 * | 1/2003 | Wong | A41F 1/006 24/303 |
| 2003/0019084 | A1 * | 1/2003 | Wong | A41F 1/006 24/303 |
| 2004/0259468 | A1 * | 12/2004 | Bergamelli | A41F 1/006 450/58 |
| 2012/0060330 | A1 * | 3/2012 | Fildan | A41F 1/002 24/303 |
| 2012/0174346 | A1 * | 7/2012 | Fildan | A41F 1/002 24/303 |
| 2015/0074954 | A1 * | 3/2015 | Pruitt | A44C 5/2071 24/303 |

* cited by examiner

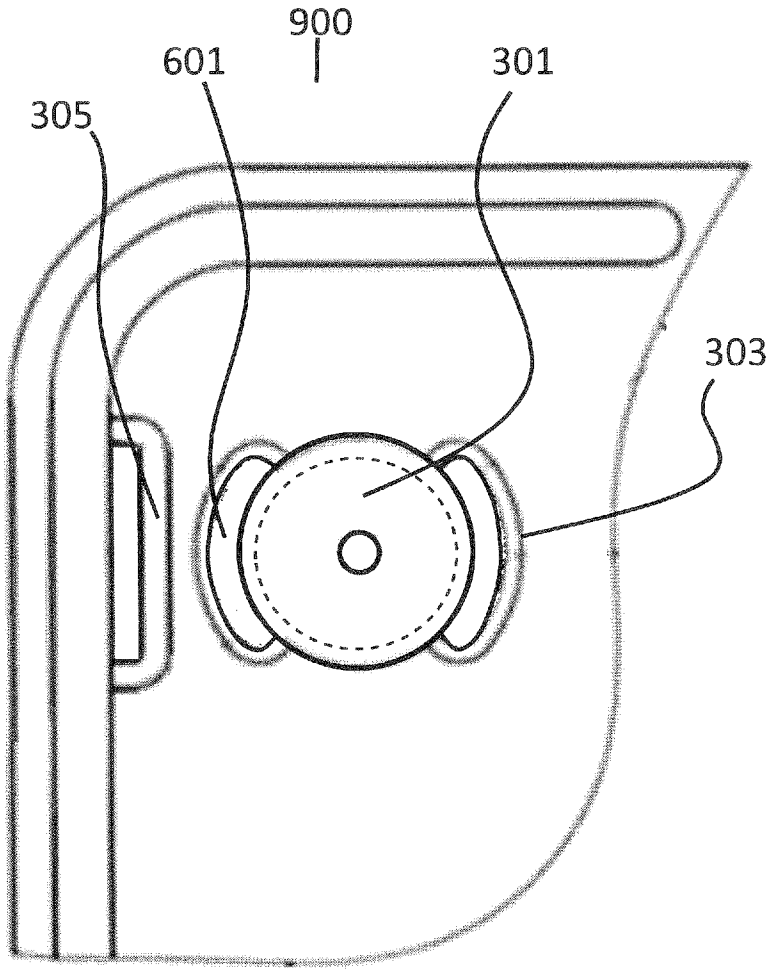
Figure 14
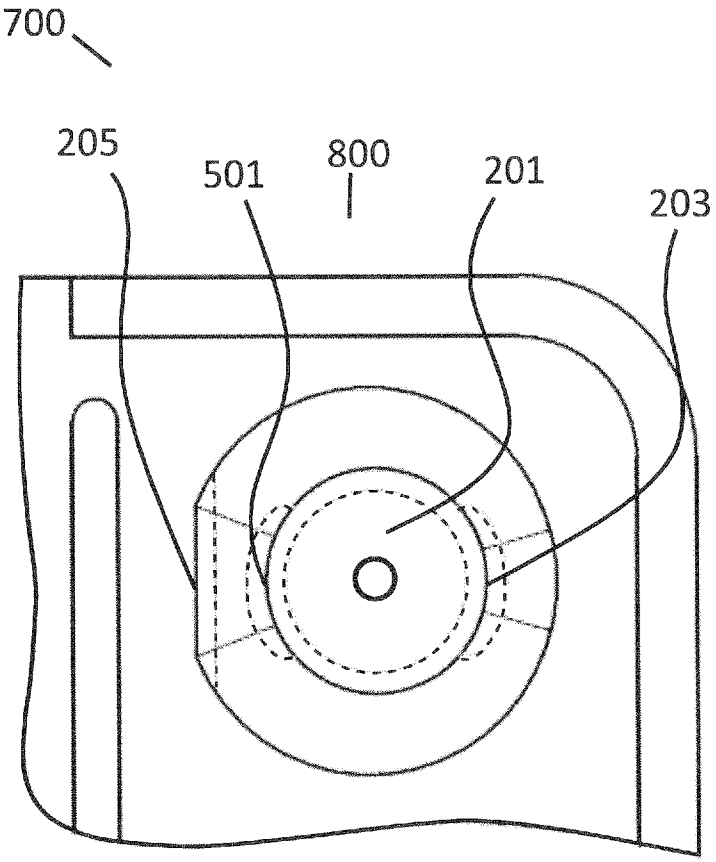

FASTENER FOR CLOTHING OR LINGERIE

TECHNICAL FIELD

This invention relates to a fastener for clothing or lingerie.

BACKGROUND ART

There are many different types of fastener used for clothing and lingerie. Perhaps the most common of these is the so-called hook and eye fastener that comprises one or more metal hooks and one or more complementary eyes for engagement by the hook. Although effective in operation, there are several shortcomings with these types of fastener. For example, it can be relatively difficult to engage the hook in the eye. This problem is exacerbated when the fastener is located to the rear of the garment and even more so if the wearer has problems with dexterity and/or flexibility.

One fastener that attempts to address these problems is that described in the applicant's own U.S. Pat. No. 8,935,835. The fastener described therein comprises a front element with a backwardly open seat cavity and a back element formed with a forwardly projecting bump. Both the bump and the seat cavity have magnets that aid the location of the bump in the seat cavity. The front and back elements have co-operating catch faces that act against unintentional separation of the fastener elements. Although a significant improvement on the existing fasteners, there is scope for improvement of the fastener described in U.S. Pat. No. 8,935,835.

Throughout this specification the fasteners are described as being used between the back wings of a brassiere, and the terms "front" and "back" are used in that context. The invention however is not limited to such use or orientation and would work equally well if reversed or applied to another application. For example, the present invention could be used as a front or side closure of a brassiere or could be used instead of buttons or as an auxiliary fastener such as next to a zip on an item of clothing or piece of luggage.

It is an object of the present invention to provide a fastener that overcomes some of the problems with the known fasteners and that provides a useful alternative to the consumer.

SUMMARY OF INVENTION

According to the invention there is provided a fastener for connecting together two pieces of which at least one is a textile, the fastener comprising:

- a front element forming a backwardly open seat cavity, and having a pair of catch faces directed towards one end of the front element, flanking the seat cavity, and angled such that the front edges of the catch faces are further from the one end than the back edges of the catch faces;
- a front magnet held in the front element immediately forward of the seat cavity;
- means for connecting the one end of the front element to one of the pieces to exert traction on the front element and magnet in a direction towards the one end;
- a back element formed with a forwardly projecting bump loosely fittable in the seat cavity, the back element having a pair of catch faces generally complementary to the catch faces of the front element and engageable therewith on engagement of the bump in the seat cavity;

- means for connecting an end of the back element to the other of the pieces to exert traction on the back element away from the one end of the front element;
- a back magnet secured in the bump, the magnets being so polarized as to attract each other and pull the bump into the seat cavity on juxtaposition of the front and back elements;

characterised in that there is provided one or more of:

- a third catch face, also referred to herein as an upwardly engagable catch face, on the front element directed substantially perpendicular to the one end of the front element, directed away from one side of the front element, and angled such that the front edge of the third catch face is closer to the side of the front element than the back edge of the third catch face and a third complementary catch face, also referred to herein as an upwardly engagable complementary catch face, on the back element engageable therewith;
- a fourth catch face, also referred to herein as a downwardly engagable catch face, on the front element directed substantially perpendicular to the one end of the front element, directed towards the one side of the front element, and angled such that the front edge of the fourth catch face is further from that side of the front element than the back edge of the fourth catch face and a fourth complementary catch face, also referred to herein as a downwardly engagable complementary catch face, on the back element engageable therewith; and
- a fifth catch face, also referred to herein as an opposingly engagable catch face, on the front element directed away from the one end of the front element and angled such that the front edge of the fifth catch face is closer to the one end than the back edge of the fifth catch face and a fifth complementary catch face, also referred to herein as an opposingly engagable complementary catch face, on the back element engageable therewith.

By having such a fastener, there will be provided a more secure engagement between the front and back elements without requiring increased dexterity or flexibility on the part of the wearer. Most importantly, the fastener will not have a tendency to open inadvertently once the wearing tension is reduced, as may occur for example with brassiere fasteners when the wearer is leaning forwards with a relaxed posture. Advantageously, the fastener is capable of resisting release forces in a direction perpendicular to and/or parallel and opposite to the normal wearing tension force normally experienced by the fastener.

In one embodiment of the invention there is provided a fastener in which two or more of the catch faces on the back element are formed integrally with each other. By having two or more of the catch faces formed integrally with each other, the back element will be of simpler construction and also will provide a more robust engagement with the front element.

In one embodiment of the invention there is provided a fastener in which the third and fourth catch faces on the back element are formed integrally with each other and with one of the pair of catch faces on the back element.

In one embodiment of the invention there is provided a fastener in which third and fourth catch faces are joined by a column on the back element, and in which the seat cavity has an annular rim defining an open mouth, the annular rim having a channel formed therein for reception of the column. This is seen as a particularly useful and effective embodiment of fastener that will provide a secure engagement between the front and back elements. By having the column and channel the fastener will be able to resist twisting forces and will be less inclined to inadvertently disengage.

In one embodiment of the invention there is provided a fastener in which the open seat cavity and the forwardly projecting bump are substantially triangular.

In one embodiment of the invention there is provided a fastener in which the corners of the substantially triangular open seat cavity and the forwardly projecting bump are rounded.

In one embodiment of the invention there is provided a fastener in which there are provided a plurality of backwardly open seat cavities on the front element.

In one embodiment of the invention there is provided a fastener in which the plurality of rearwardly open seat cavities on the front element are connected together by way of a flexible substrate. This is seen as useful as the front element will be more flexible and easier to mate with the back element as well as being more comfortable for the wearer.

In one embodiment of the invention there is provided a plurality of forwardly projecting bumps on the back element.

In one embodiment of the invention there is provided a fastener in which the plurality of forwardly projecting bumps on the back element are mounted on a base plate thereby holding the forwardly projecting bumps in a fixed spaced relationship with respect to each other. By placing the forwardly projecting bumps onto a single base plate, the back element will be easier to mold and align with the remainder of the back element components.

In one embodiment of the invention there is provided a fastener in which the number of rearwardly open seat cavities on the front element is greater than the number of forwardly projecting bumps on the back element.

In one embodiment of the invention there is provided a fastener in which the third catch face is located internal the rearwardly open seat cavity. This is seen as a very simple construction and will allow the forwardly projecting bump to be modified to provide the corresponding catch face. Together, they provide a very simple construction of fastener.

In one embodiment of the invention there is provided a fastener in which the fourth catch face is located internal the rearwardly open seat cavity. This is also seen as a very simple construction and will allow the forwardly projecting bump to be modified to provide the corresponding catch face. Together, they provide a very simple construction of fastener.

In one embodiment of the invention there is provided a fastener in which the fifth catch face is located internal the rearwardly open seat cavity. Again, this is seen as a very simple construction and will allow the forwardly projecting bump to be modified to provide the corresponding catch face. Together, the seat cavity and the bump provide a very simple construction of fastener.

In one embodiment of the invention there is provided a fastener in which of the third, fourth and fifth catch faces and the third, fourth and fifth complementary catch faces, there is provided only the third and fourth catch faces and the third and fourth complementary catch faces.

In one embodiment of the invention there is provided a fastener in which of the third, fourth and fifth catch faces and the third, fourth and fifth complementary catch faces, there is provided only the fifth catch face and the fifth complementary catch face.

BRIEF DESCRIPTION OF THE DRAWINGS

The invention will now be more dearly understood from the following description of some embodiments thereof given by way of example only with reference to the accompanying drawings, in which:—

FIG. 14 is a rear view of a front element and a front view of a back element of a third embodiment of fastener according to the invention.

DETAILED DESCRIPTION OF THE DRAWINGS

Figure 2:
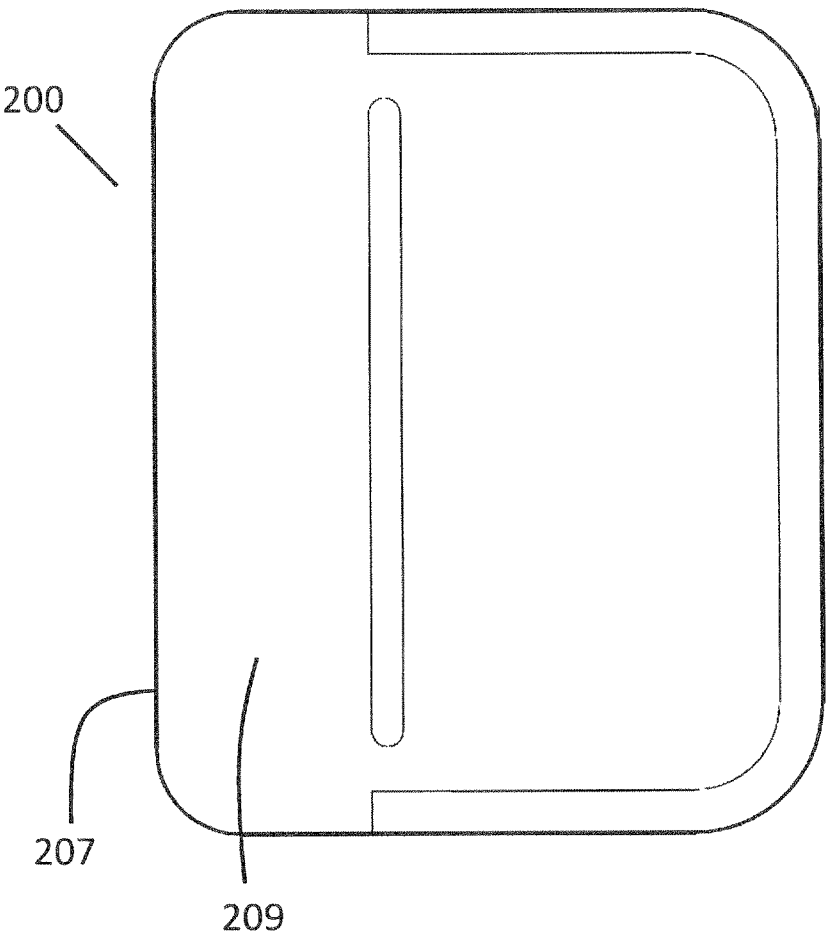
FIG. 2 is a front view of a front element of the fastener of FIG. 1.
Figure 1:
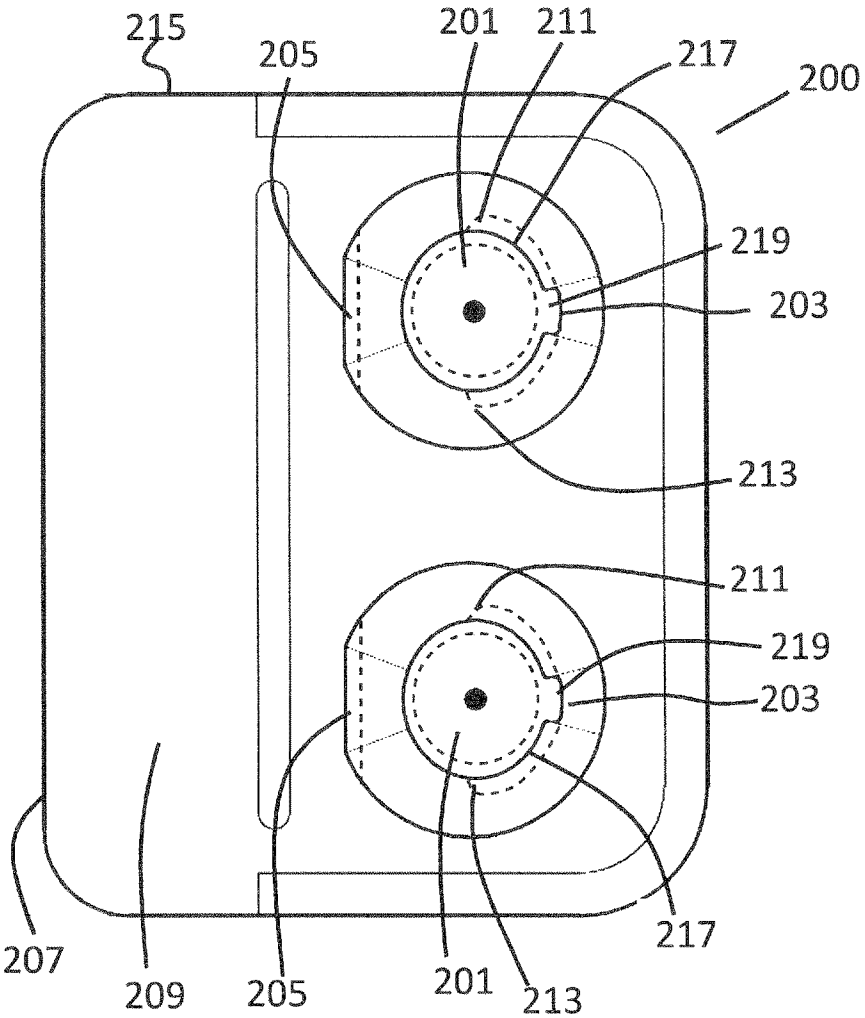
FIG. 1 is a rear view of a front element of a fastener according to the invention.

Referring to FIGS. 1 to 5 inclusive, there is shown a fastener 100 for connecting two pieces (not shown) together. The fastener 100 comprises a front element 200 for connection to one of the pieces and a back element 300 for connection to the other of the pieces. Referring specifically to FIGS. 1 and 2, there is shown a rear view and a front view respectively of the front element 200. The front element 200 comprises a pair of backwardly open seat cavities 201 each having a pair of catch faces 203, 205 directed towards one end 207 of the front element. The catch faces 203, 205 flank the seat cavity and are angled such that the front edges of the catch faces 203, 205 are further away from the one end 207 than the back edges of the catch faces 203, 205. A magnet (not shown) is housed in the front element immediately forward of the seat cavity 201. The magnet is fully enclosed to prevent rusting. There is provided means, in this case provided by way of a fabric tab 209 for connecting the one end 207 to one of the pieces (not shown).

The front element 200 comprises a third catch face 211 and a fourth catch face 213. The third catch face 211 is directed substantially perpendicular to the one end 207 of the front element 200 and is directed away from one side 215 of the front element. The third catch face 211 is angled such that the front edge of the third catch face is closer to the side 215 of the front element than the back edge of the third catch face 211. The fourth catch face 213 is also directed substantially perpendicular to the one end 207 of the front element 200 but is directed towards the one side 215 of the front element so that the front edge of the fourth catch face is further from the side 215 of the front element 200 than the back edge of the fourth catch face 213. At least portion of the third and fourth catch faces is directed substantially perpendicular to the one end 207 of the front element however other portion of the third and fourth catch faces may be directed at an angle substantially less than perpendicular to the one end 207 of the front element 200.

The seat cavities 201 each comprise an annular rim 217 defining an open mouth of the seat cavity. There is further provided a channel 219 formed in the annular rim 217 for reception of a complementary column (not shown) of the back element 300, as will be described in greater detail below.

Figure 4:
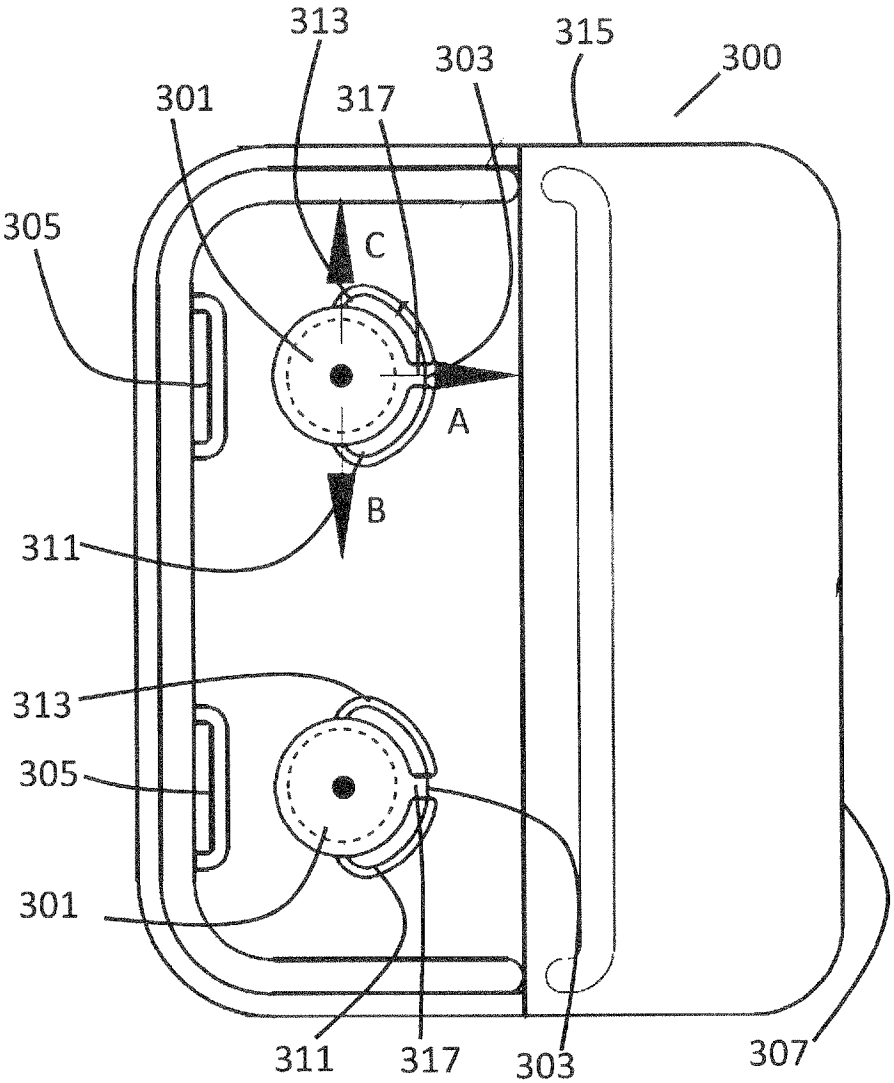
FIG. 4 is a front view of a back element of a fastener of FIG. 3.
Figure 3:
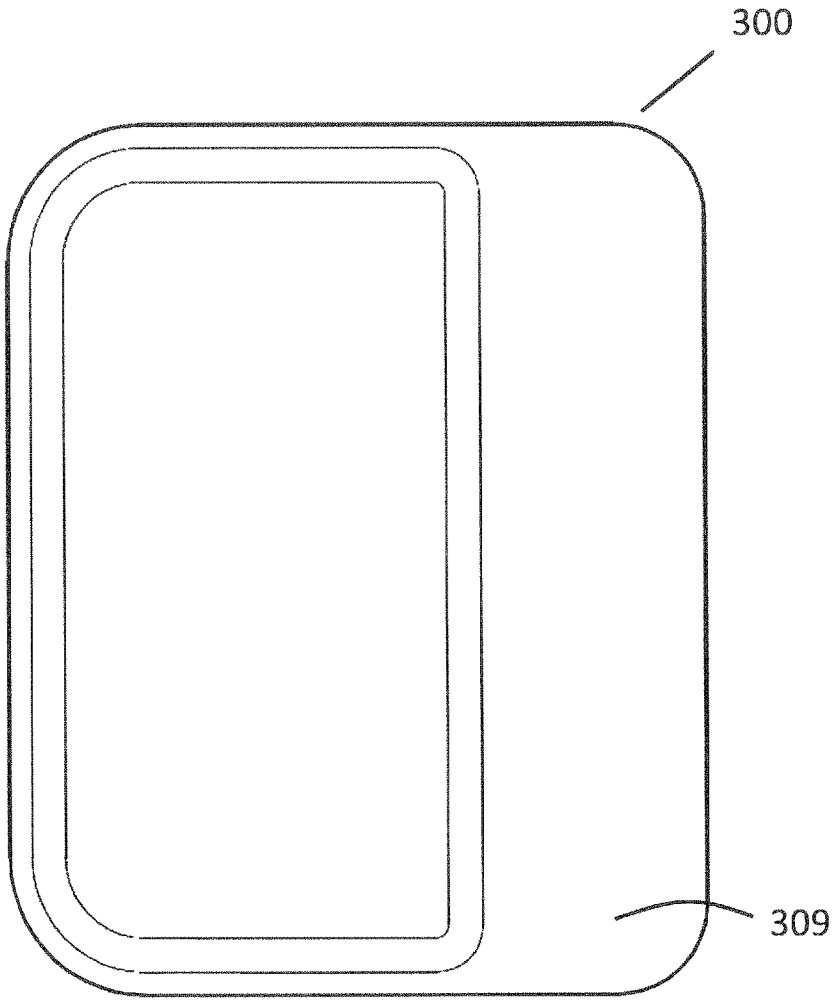
FIG. 3 is a rear view of a back element of a fastener according to the invention.

Referring now specifically to FIGS. 3 and 4, there is shown a rear view and a front view respectively of the back element 300. The back element 300 comprises a pair of spaced apart forwardly projecting bumps 301 each having a pair of complementary catch faces 303, 305 for engagement of the catch faces 203, 205 respectively of the front element 200. The catch faces 303, 305 are directed towards one end 307 of the back element 300 and away from the one end 207 of the front element when the front and back elements are in engagement. The catch faces 303, 305 are angled such that the front edges of the catch faces 303, 305 are closer to the one end 307 than the back edges of the catch faces 303, 305. The back element 300 comprises a magnet (not shown), housed in the bump 301, the location of which is represented by a dashed line. The magnet is fully enclosed to prevent rusting. There is provided means, in this case provided by way of a fabric tab 309, for connecting the one end 307 to another of the pieces (not shown).

The back element 300 further comprises a third complementary catch face 311 for engagement with the third catch face 211 and a fourth complementary catch face 313 for engagement with the fourth catch face 213. The third complementary catch face 311 is directed substantially perpendicular to the one end 307 of the back element 300 and is directed away from one side 315 of the back element. The third complementary catch face 311 is angled such that the front edge of the third complementary catch face is further from the side 315 of the back element than the back edge of the third complementary catch face 311. The fourth complementary catch face 313 is also directed substantially perpendicular to the one end 307 of the back element 300 but is directed towards the one side 315 of the back element 300 so that the front edge of the fourth complementary catch face is closer to the side 315 of the back element 300 than the back edge of the fourth complementary catch face 313.

As will be understood from the following description, the pair of catch faces 303, 305 are operable to resist a force in the direction of arrow "A" in FIG. 4, the catch face 311 is operable to resist a force in the direction of arrow "B" in FIG. 4 and the catch face 313 is operable to resist a force in the direction of arrow "C" in FIG. 4.

The bumps 301 each comprise a column 317 for engagement in the channel 219 of the front element. The columns 317 effectively provide one of the pair of catch faces 303 and join the third complementary catch face 311 and the fourth complementary catch face 313 together. When the column 317 is engaged in the channel 219, this will reduce the likelihood of the bump twisting in the cavity seat and becoming dislodged therefrom.

Figure 5:
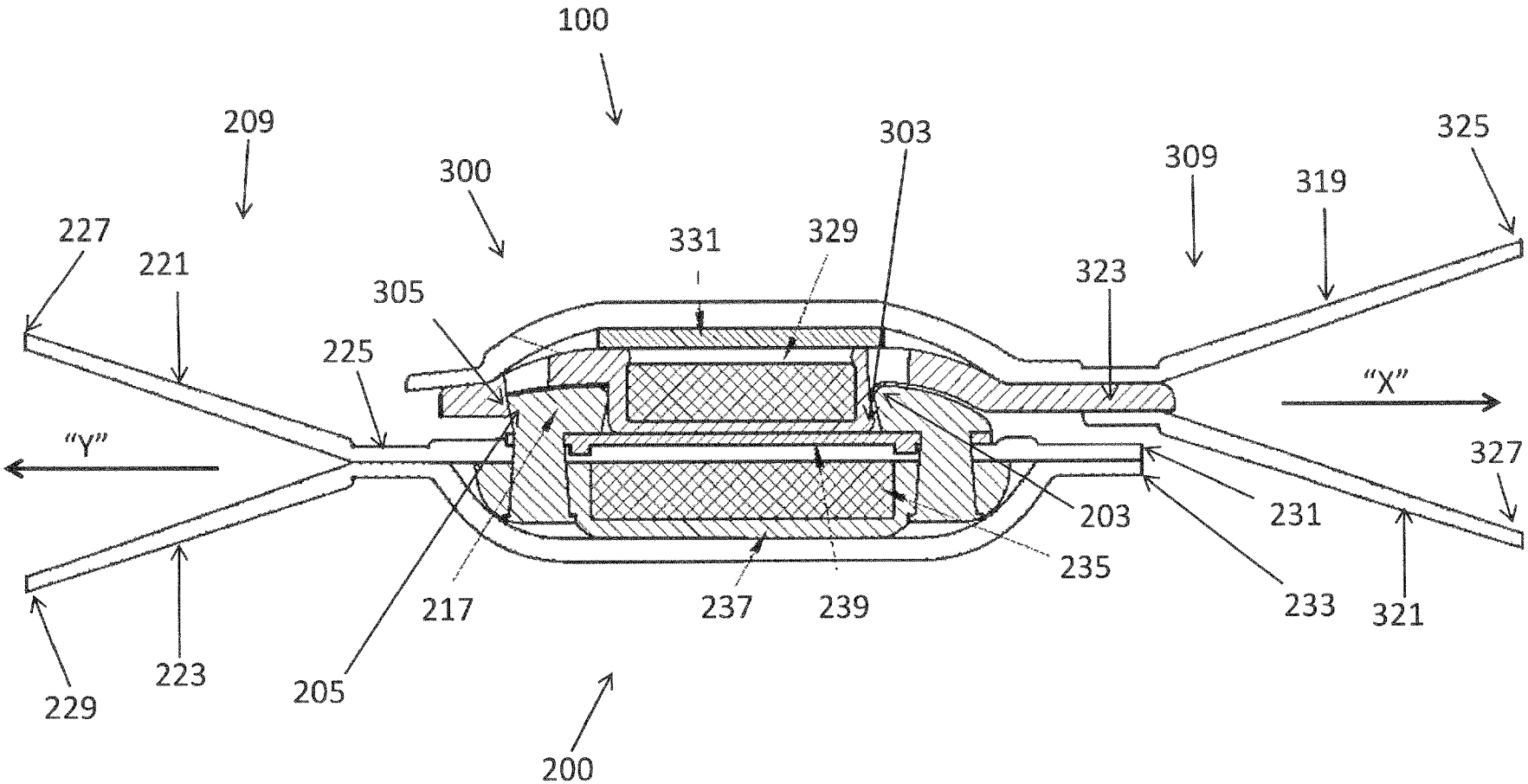
FIG. 5 is a cross sectional view of a fastener according to the invention with the front and back elements in engagement.

Referring to FIG. 5, there is shown a cross sectional view of the fastener 100 with the front element 200 and back element 300 in engagement with each other. It can be seen that the complementary catch faces 303, 305 of the back element 300 are in engagement with the catch faces 203, 205 respectively of the front element 200. These catch faces prevent inadvertent release of the fastener 100 caused by a force on the back element 300 in the wearing direction, indicated by the arrow "X", and/or a force on the front element 200 in the wearing direction, indicated by the arrow "Y" (in other words, forces pulling the front 200 and back 300 elements apart).

The fabric tab 209 of the front element 200 comprises a pair of strips of fabric 221, 223. The strips of fabric are connected together at a point 225 spaced apart from their free ends 227, 229 to allow a piece (not shown) to be engaged between the free ends 227, 229 of the strips of fabric. The other ends 231, 233 of the strips are connected together and at least part of the seat cavity is sandwiched between the strips of fabric 221, 223 intermediate the other ends 231, 233 and the point 225. The front element 200 has a magnet 235 housed in a casing 237 forward of the seat cavity. The magnet is retained in the casing by the strip of fabric 221 and a seal 239 above the strip of fabric 221. The seal 239 also forms the base of the seat cavity.

The back element 300 has a fabric tab 309 that also comprises a pair of strips of fabric 319, 321. However, in this instance, the strips 319, 321 are not connected directly together but instead are connected to a base 323 upon which the bumps 301 are mounted. The base 323 is partially sandwiched between the pair of strips 319, 321. The free ends 325, 327 of the strips 319, 321 are spaced apart from each other to allow the other piece (not shown) to be engaged between the free ends 325, 327 of the strips 319, 321. A magnet 329 is housed in the bump 301 and is retained in the bump by a seal 331 and the strip 319. The magnets 235 and 329 are polarised to attract each other thereby facilitating location of the bump 301 in the seat cavity 201.

Figure 6:
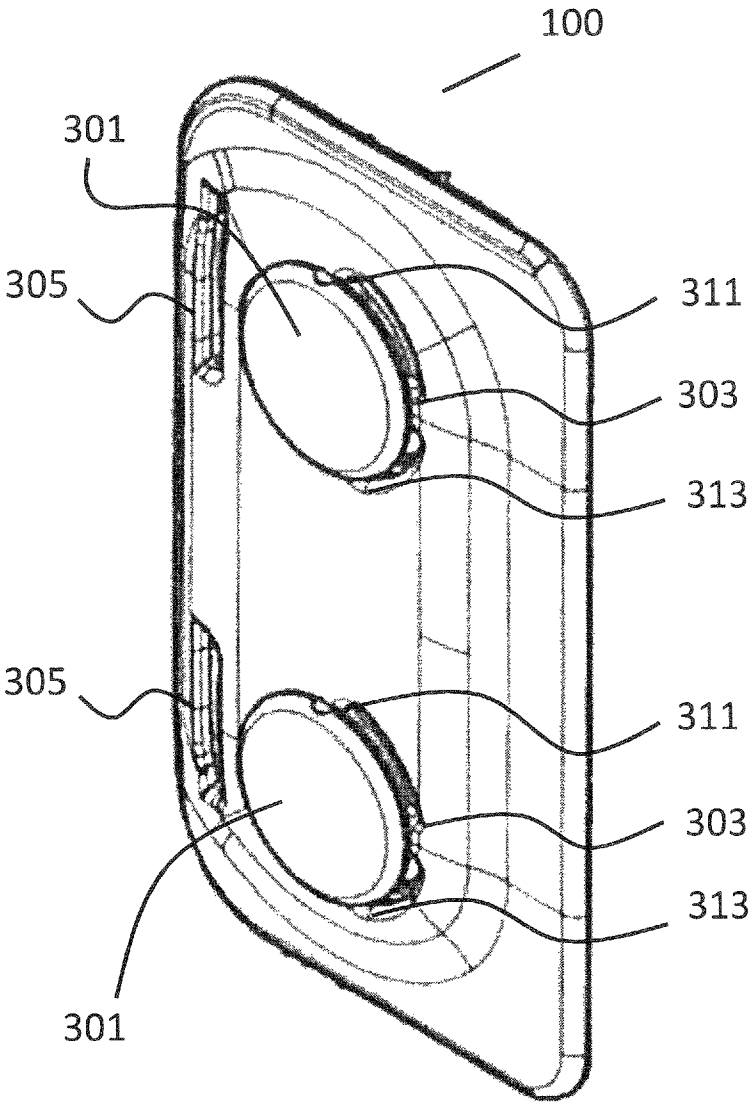
FIG. 6 is an isometric view of the fastener according to the invention.
Figure 8:
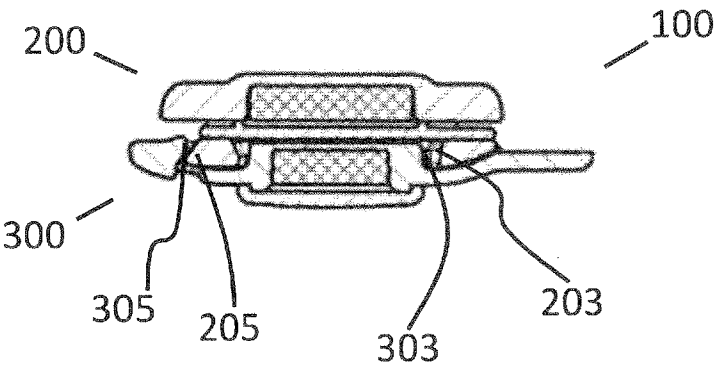
FIG. 8 is a cross-sectional view along the lines A-A of FIG. 7.
Figure 7:
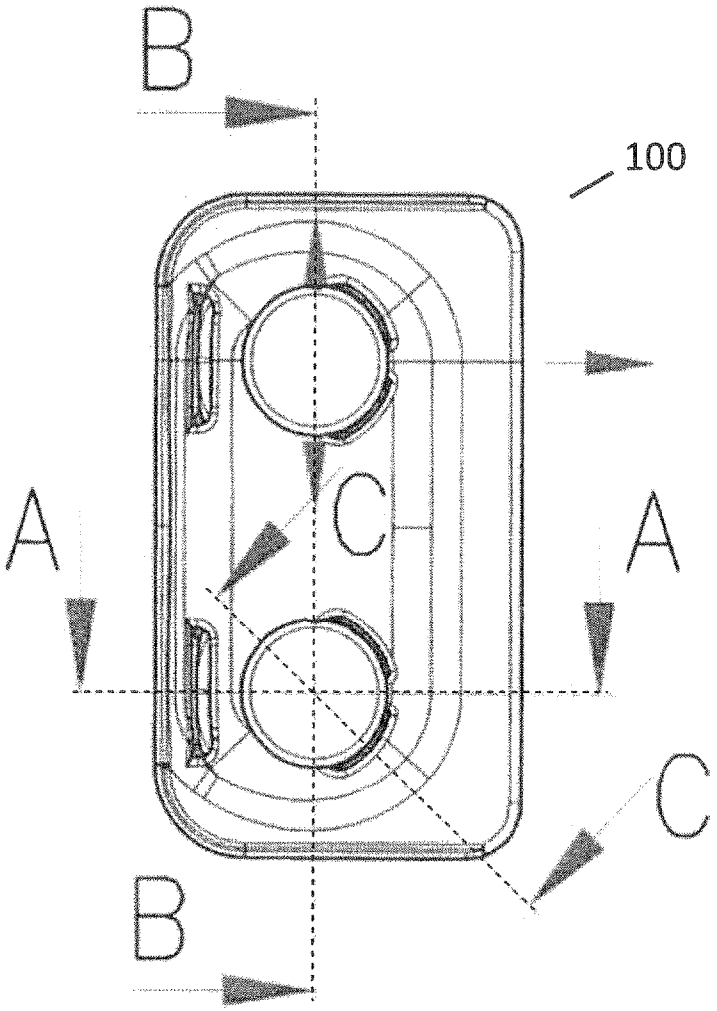
FIG. 7 is a front view of the fastener according to the invention.
Figure 10:
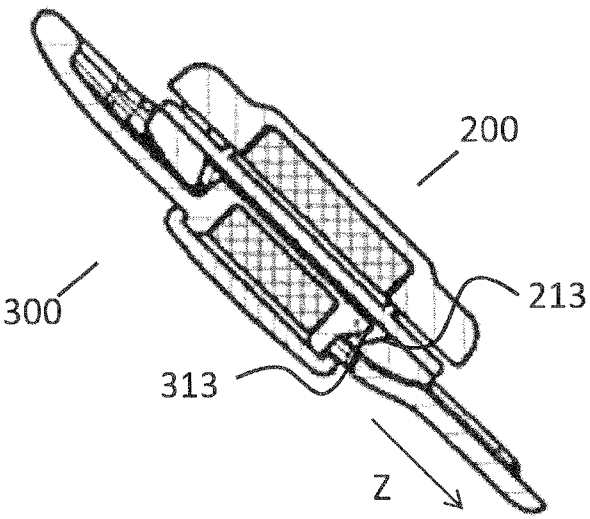
FIG. 10 is a cross-sectional view along the lines C-C of FIG. 7.
Figure 9:
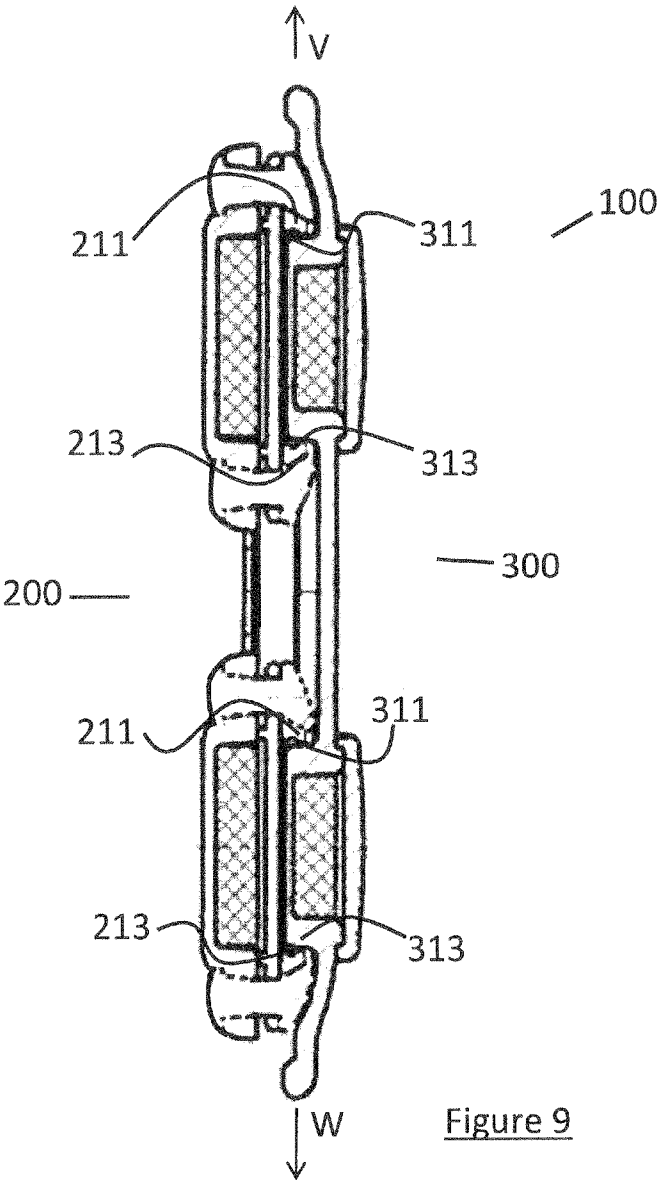
FIG. 9 is a cross-sectional view along the lines B-B of FIG. 7.

Referring to FIGS. 6 to 10 inclusive, there are shown various views of the fastener 100 with the front element 200 and back element 300 in engagement and with the fabric tabs 209, 309 removed for clarity. FIG. 6 shows a rear isometric view of the fastener. FIG. 7 illustrates a rear view of the fastener 100. FIGS. 8 to 10 inclusive are cross sectional views of the fastener 100 along the lines "A-A", "B-B" and "C-C" respectively of FIG. 7. FIG. 8 is a view similar to FIG. 5 with the front element shown on top and the back element shown on bottom. It can be seen that the complementary catch faces 303, 305 of the back element 300 are in engagement with the catch faces 203, 205 respectively of the front element 200. These catch faces prevent inadvertent release of the fastener 100 caused by a force on the back element in the wearing direction (as described above).

Referring specifically to FIG. 9, there is shown a cross sectional view of the fastener 100 along the lines "B-B" of FIG. 7. It can be seen that in the event of the back element being urged upwards relative to the front element in the direction of the arrow "V", the third catch faces 211 will engage with complementary catch faces 311 to act against the upwards force and prevent unwarranted dislodgement of the bump from the seat cavity and hence release of the back element from the front element. It can also be seen that in the event of the back element being urged downwards relative to the front element in the direction of the arrow "W", the fourth catch faces 213 will engage with the complementary catch faces 313 to act against the downwards force and again prevent unwarranted dislodgement of the bump from the seat and opening of the fastener.

Referring now to FIG. 10, there is shown a cross sectional view of the fastener 100 along the lines "C-C" of FIG. 7. It can be seen that the complementary catch face 313 of the back member is dimensioned to engage securely with the fourth catch face 213 in the event of a force pulling the back member in a direction of the arrow "Z" which is a direction between a downwards force and a wearing force experienced by the back element.

Figure 12:
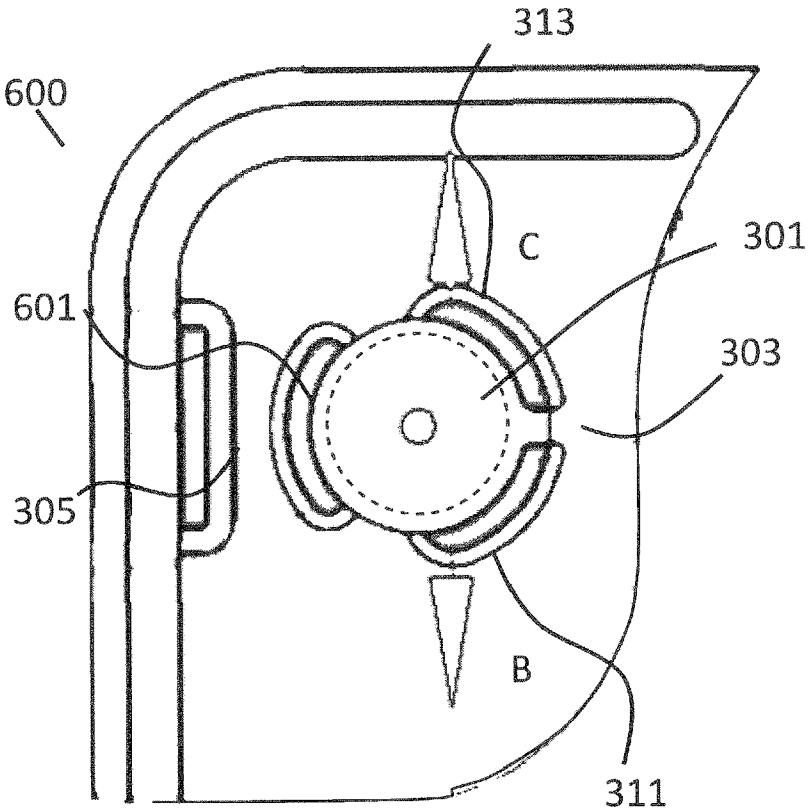
FIG. 12 is a front view of a back element of a second embodiment of fastener according to the invention.
Figure 11:
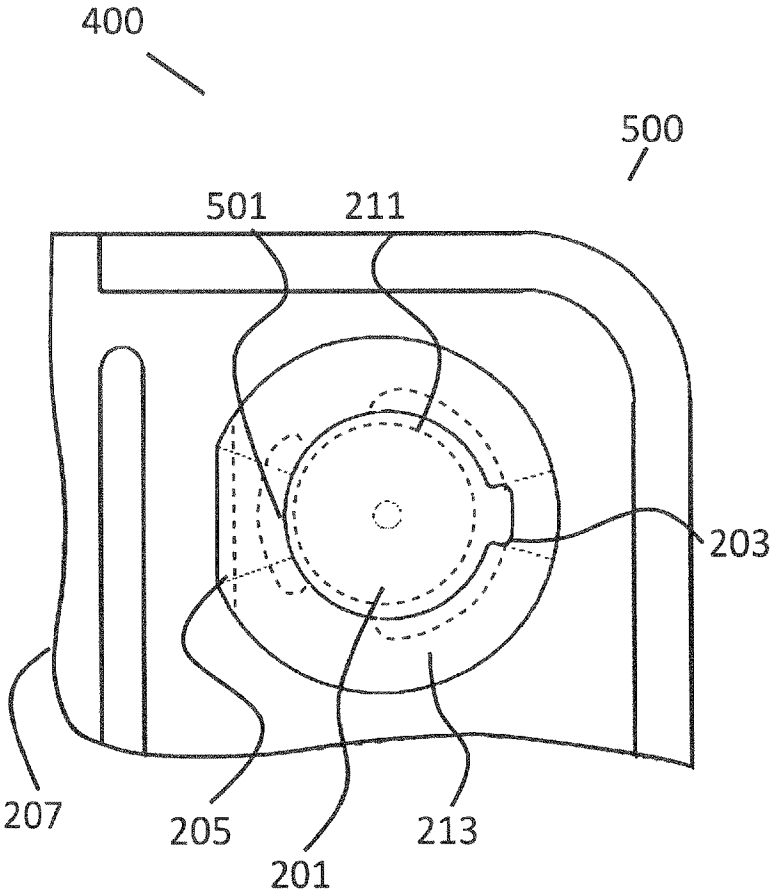
FIG. 11 is a rear view of a front element of a second embodiment of fastener according to the invention.
Figure 13:
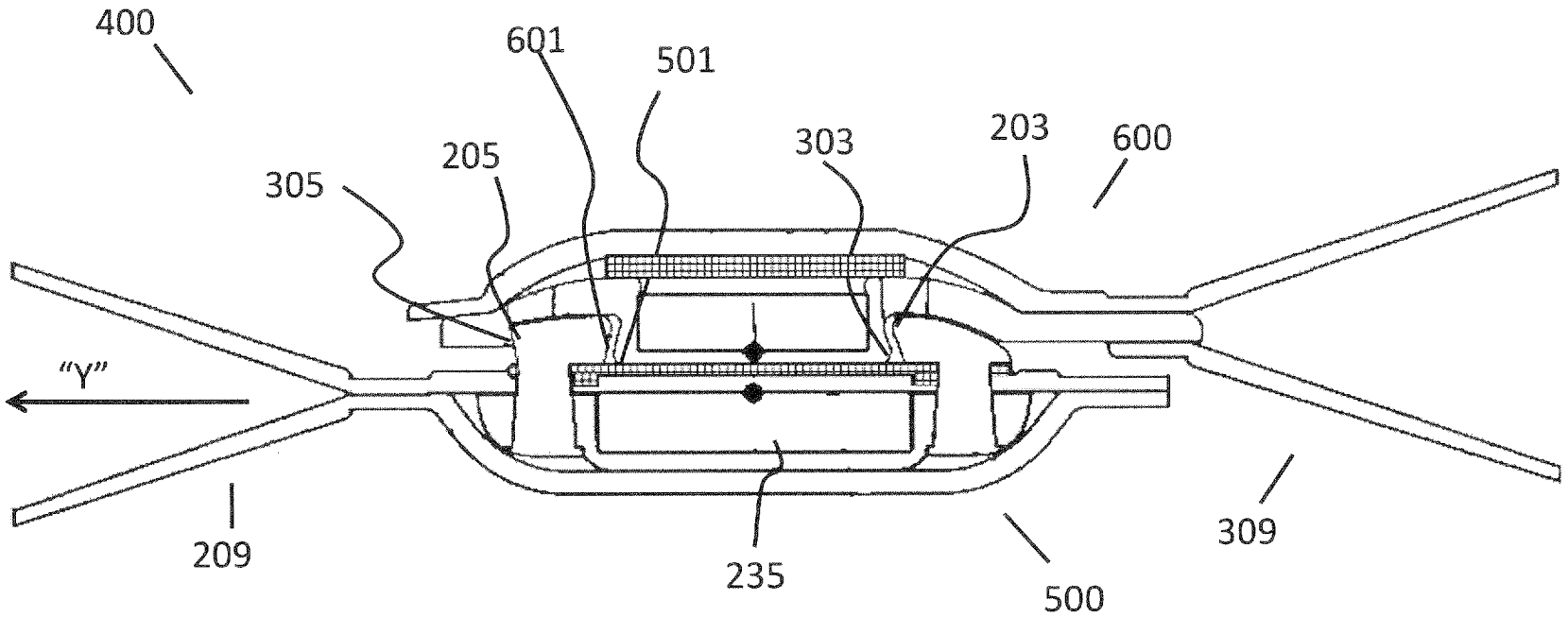
FIG. 13 is a cross sectional view of a fastener according to the invention with the front element of FIG. 11 and back element of FIG. 12 in engagement.

Referring to FIGS. 11 to 13 inclusive, there is shown a second embodiment of fastener according to the invention, indicated generally by the reference numeral 400, where like parts have been given the same reference numeral as before. The fastener 400 comprises a front element 500 and a back element 600. The front element 500 is similar to the front element 200 of the embodiment described in FIGS. 1 to 10 inclusive above with the exception that the front element 500 further comprises a fifth catch face 501. Furthermore, the back element 600 is similar to the back element 300 of the embodiment described in FIGS. 1 to 10 inclusive with the exception that the back element 600 further comprises a fifth complementary catch face 601.

Referring specifically to FIG. 13, it can be seen that the fifth catch face 501 engages with the fifth complementary catch face 601 in the event of a force pulling the back element in the direction of the arrow "Y" (in other words, in a direction of the wearing force exerted on the front element and opposite to the normal wearing force exerted on the back element). This fifth catch provided by the fifth catch face 501 and fifth complementary catch face 601 will prevent inadvertent release of the bump from the seat cavity when the wearer of the brassiere is relaxed and leaning forwards.

Referring now to FIG. 14, there is shown a third embodiment of fastener according to the invention, indicated generally by the reference numeral 700, where like parts have been given the same reference numeral as before. The fastener 700 comprises a front element 800 and a back element 900. The front element 800 is similar to the front element 500 of the embodiment described in FIGS. 11 to 13 inclusive above with the exception that the front element 800 is not provided with third and fourth catch faces and the back element 900 is not provided with third and fourth complementary catch faces. Furthermore, the front element 800 does not have a channel and the back element does not have a complementary column. Therefore it will be understood that the fastener 700 shown in FIG. 14 is suitable for resisting forces in the direction of the normal wearing forces and in the direction opposite to the normal wearing forces, but will not be as effective against forces perpendicular to the normal wearing forces.

Figure 15B:
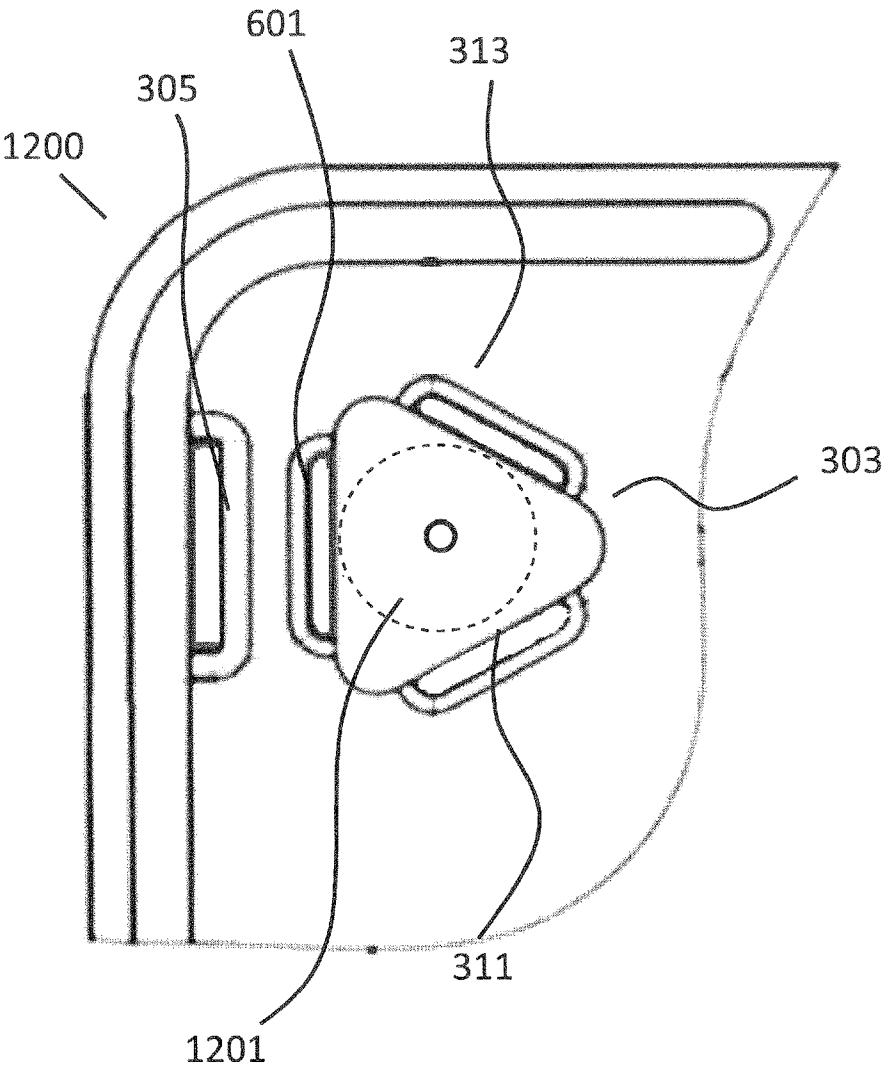
FIGS. 15(*a*) and (*b*) are a rear view of a front element and a front view of a back element respectively of a fourth embodiment of fastener according to the invention.
Figure 15A:
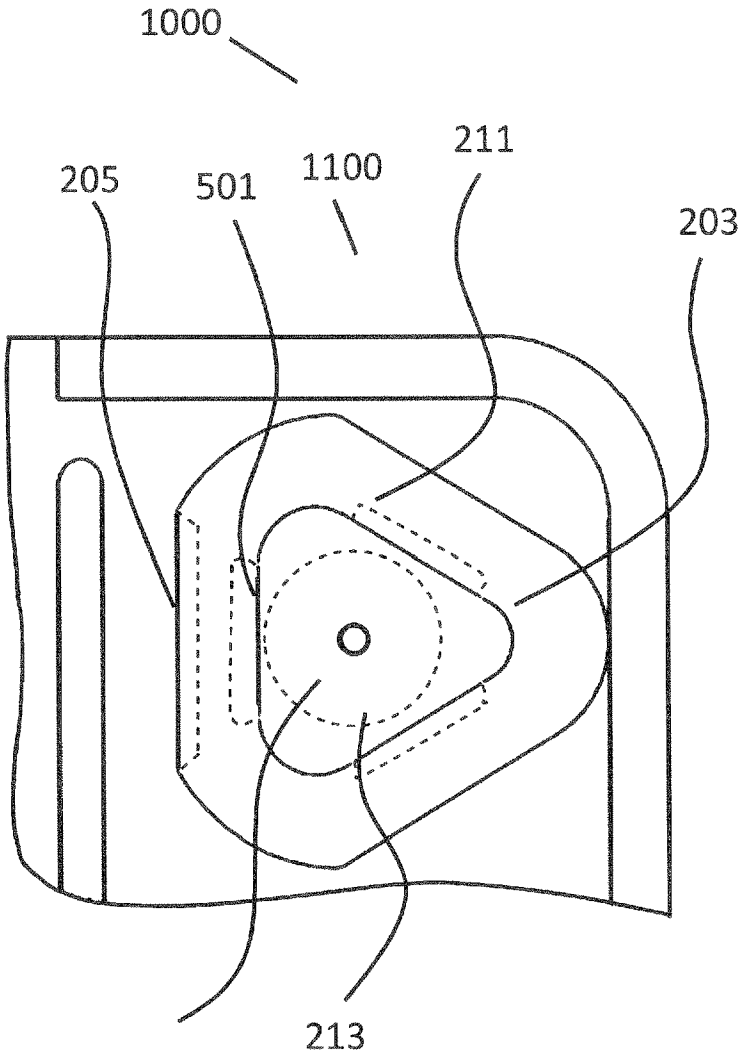

Referring to FIGS. 15(*a*) and 15(*b*), there is shown a fourth embodiment of fastener according to the invention, indicated generally by the reference numeral 1000, where like parts have been given the same reference numeral as before. The fastener 1000 comprises a front element 1100 and a back element 1200. The front element 1100 is similar to the front element 500 of the embodiment described in FIGS. 11 to 13 inclusive above with the exception that the front element 1100 is provided with a substantially triangular seat cavity 1101. Additionally, the back element 1200 has a substantially triangular forwardly projecting bump 1201.

It will be understood that while the efficacy of the catch face 303 against the normal wearing force will be reduced in this configuration, resistance against the normal wearing force will nevertheless be provided by the catch faces 303, 305 and also by parts of catch faces 311 and 313. Resistance to forces in the direction opposite to the normal wearing force will be provided by the catch face 601 and resistance to forces in directions perpendicular to the normal wearing force will be provided by catch faces 311 and 313.

Figures 16A, 16B:
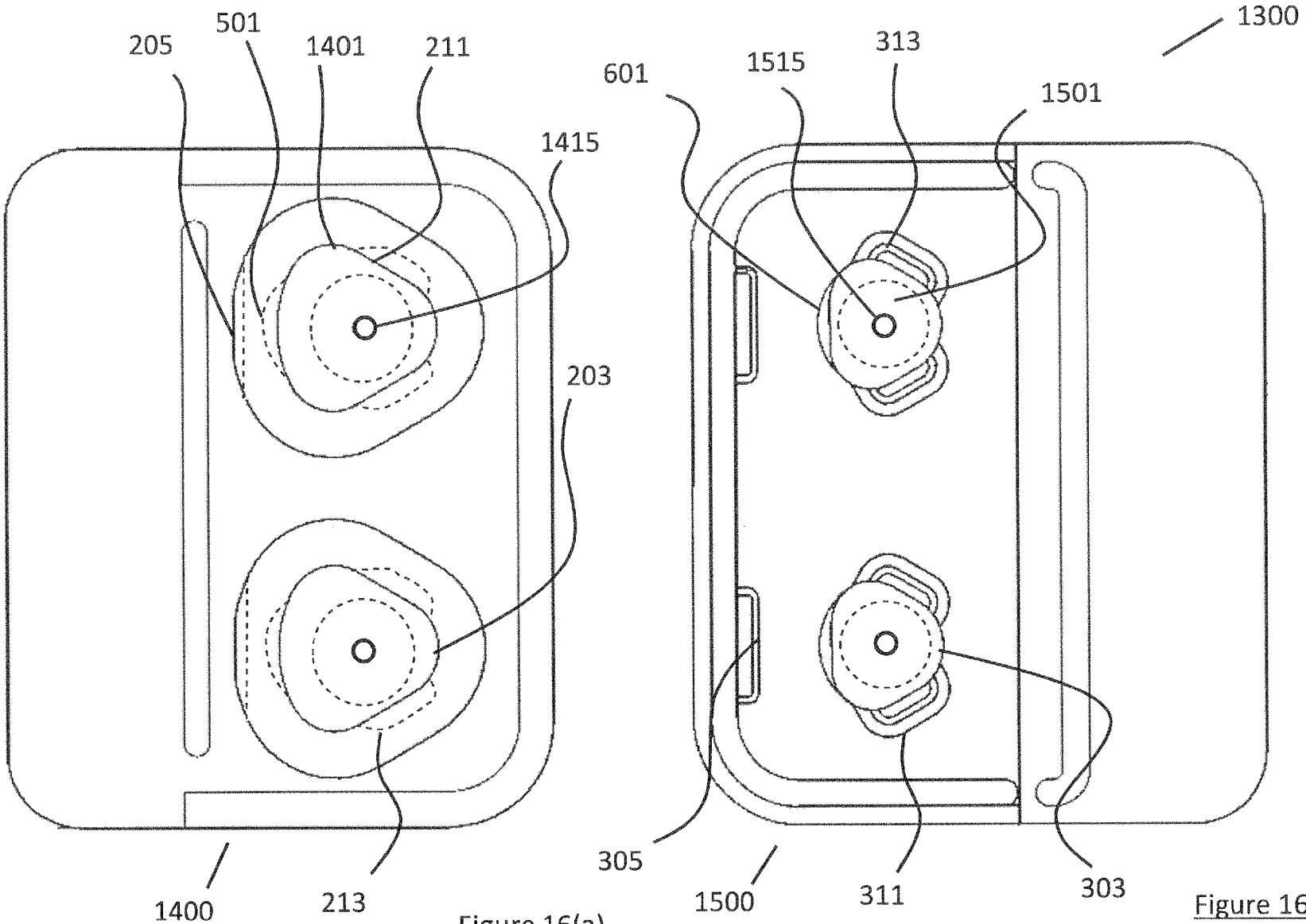
FIGS. 16(*a*) and (*b*) are a rear view of a front element and a front view of a back element respectively of a fifth embodiment of fastener according to the invention.

Referring to FIGS. 16(*a*) and 16(*b*), there is shown a fifth embodiment of fastener according to the invention, indicated generally by the reference numeral 1300, where like parts have been given the same reference numeral as before. The fastener 1300 comprises a front element 1400 and a back element 1500. The front element 1400 is similar to the front element 1100 of the embodiment described in FIG. 15(*a*) above with the exception that the front element 1400 is provided with a substantially rounded triangular seat cavity 1401. It can be seen that the centre 1415 of the magnet of the front element is not centred with respect to the seat cavity 1401. Additionally, the back element 1500 has a substantially rounded triangular forwardly projecting bump 1501. The centre 1515 of the magnet is not centred with respect to the forwardly projecting bump 1501 in which it is housed.

Figure 18:
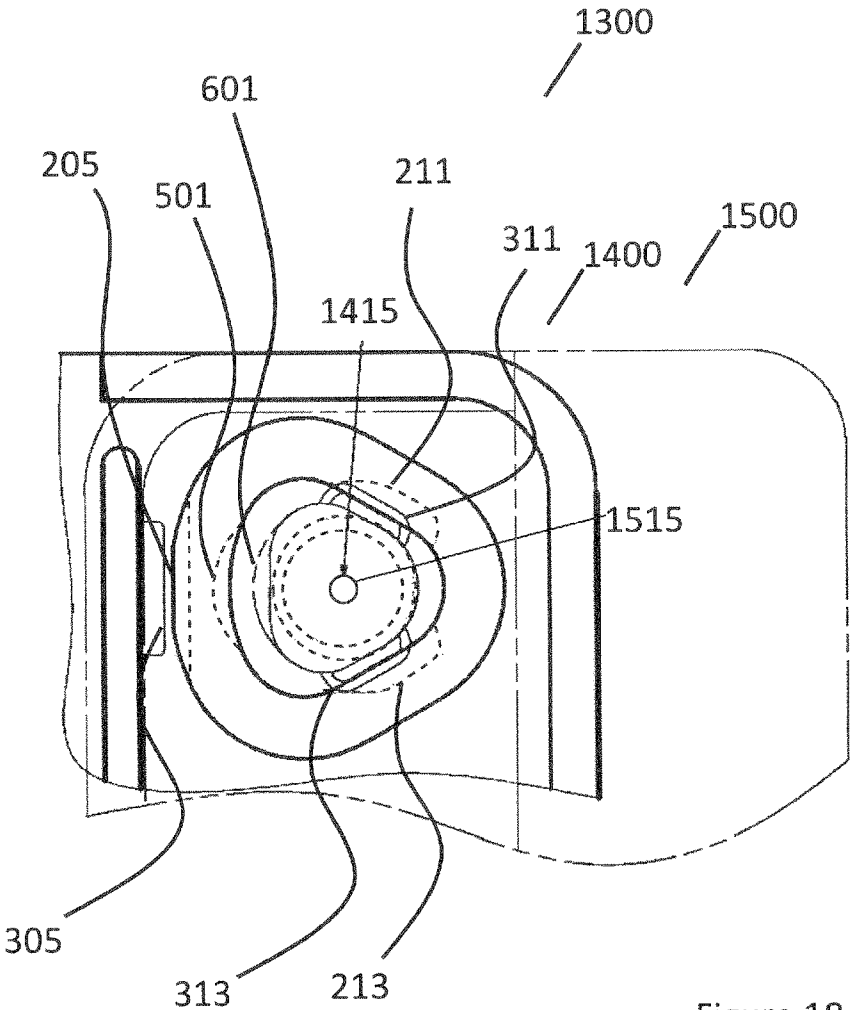
FIGS. 17 to 19 inclusive are a rear view of part of the front element of FIG. 16 with parts of the back element shown in ghost outline.
Figure 17:
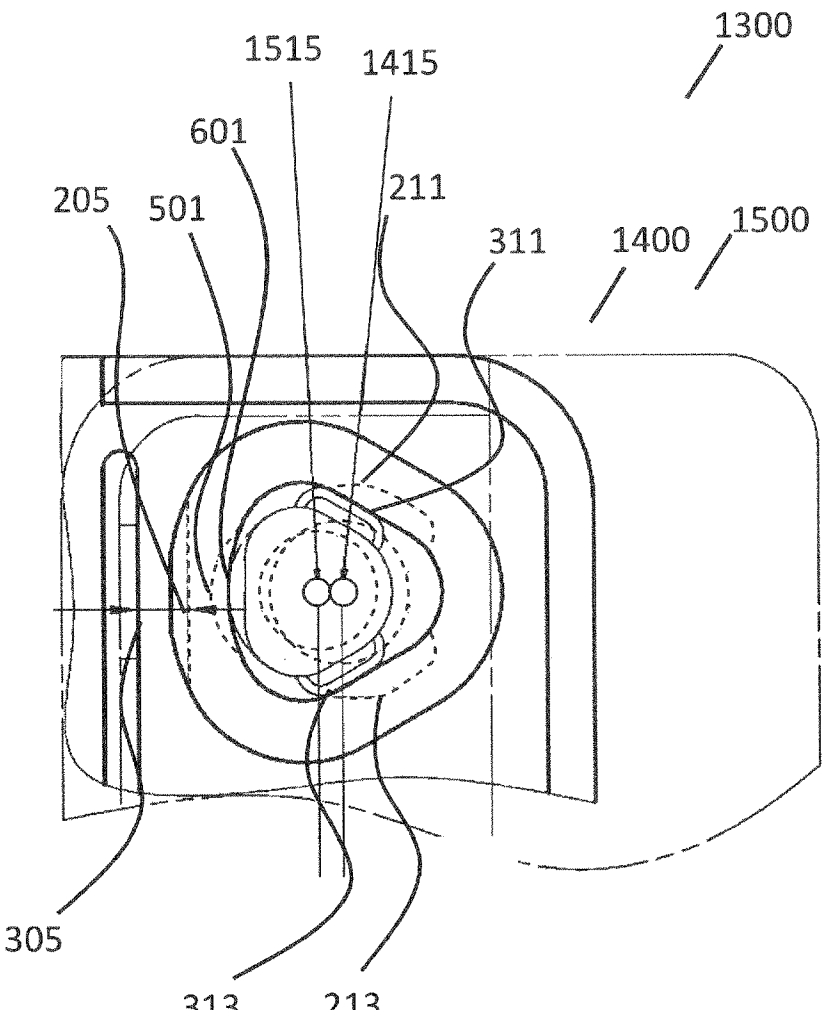
Figure 19:
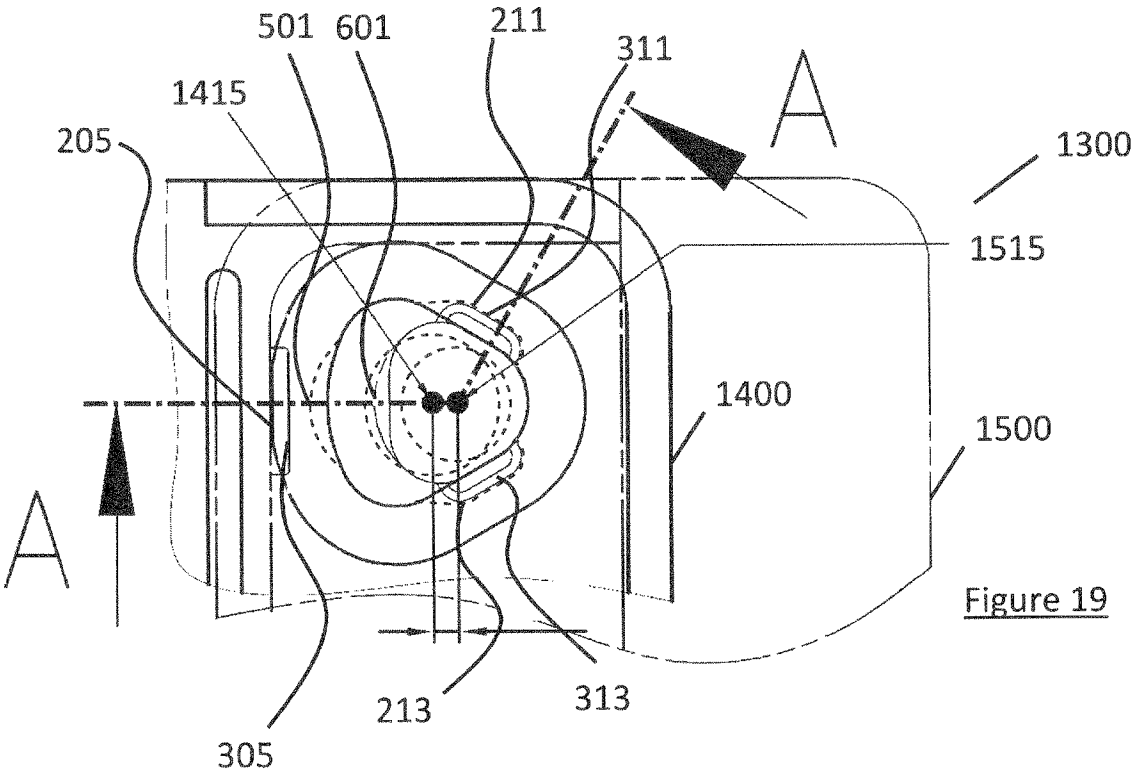

Referring to FIGS. 17 to 19 inclusive, there are shown views of the front and back elements of the fastener 1300 in various stages of engagement. Starting with FIG. 17, there is shown the front element 1400 with parts of the back element 1500 shown in ghost outline immediately after insertion of the bump into the seat cavity 1401. It can be seen that none of the catch faces 205, 211, 213 or 501 are engaged with their respective corresponding catch faces 305, 311, 313 and 601 in this position. Additionally, the centres 1415, 1515 of the magnets are not aligned.

Referring now to FIG. 18, there is shown the front element 1400 with parts of the back element 1500 shown in ghost outline in a second stage of engagement. It can be seen that the force of the magnets has pulled the centres of the magnets 1415 and 1515 from the position shown in FIG. 17 into alignment. The catch faces 211 and 213 are engaged with respective complementary catch faces 311 and 313. The catch faces 205 and 501 are not engaged with their respective complementary catch faces 305 and 601.

Referring to FIG. 19, there is shown a third stage of engagement of the front 1400 and back 1500 elements. In this configuration, the fastener is understood to be under normal wearing tension. The catch faces 211, 213 and 205 are in secure engagement with their respective complementary catch faces 311, 313 and 305. The catch face 501 is not engaged with its complementary catch face 601. It can be seen that the centre 1515 of the magnet in the forwardly projecting bump is no longer centred with respect to the centre of the magnet in the seat cavity once more.

These stages of engagement dearly illustrate the security of the fastener when it is under no tension and when it is under normal wearing tension. In order to release the fastener, the back element is moved against the force of the normal wearing tension from the configuration shown in FIG. 19 back to the configuration shown in FIG. 17 in which the catch faces are free of their complementary catch faces. In this position the fastener may be opened.

Figure 20:
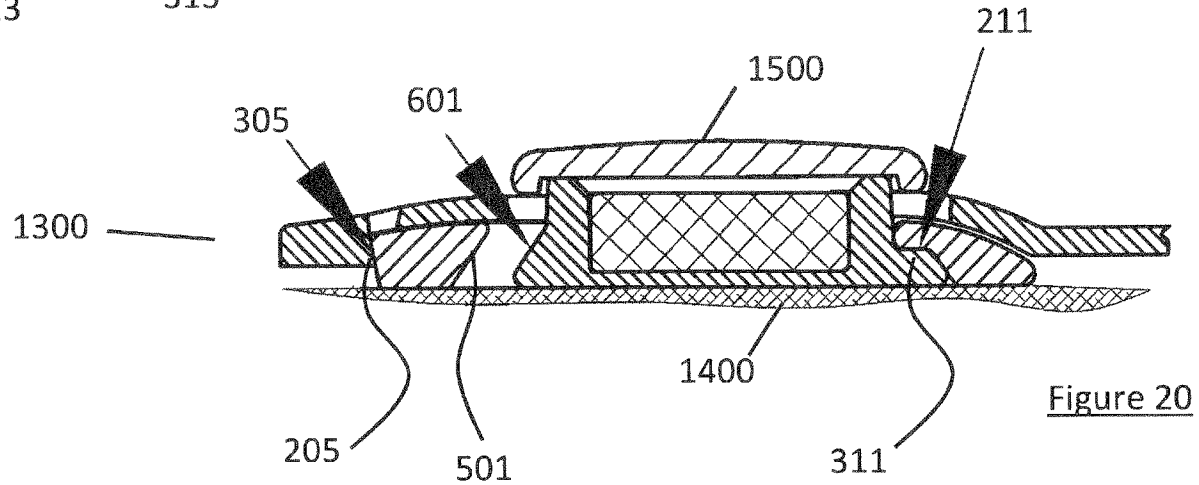
FIG. 20 is a cross sectional view of part of a fastener along the lines A-A of FIG. 19.

Finally, referring to FIG. 20, there is shown a cross section of the fastener 1300 under wearing tension along the lines A-A of FIG. 19. There can be seen the catch faces 205 and 211 in secure engagement with their respective corresponding catch faces 305 and 311. However, the catch faces 501 and 601 are not in engagement. It can also be seen that the catch face 311 differs to that in previous embodiments in that it protrudes further from the bump to provide a more secure and deeper engagement. Furthermore, the catch face 311 and complementary catch face 211 both have a stepped profile. This prevents twisting and accidental disengagement of the front and back elements.

In the examples shown, there are typically two bumps and two seat cavities provided on each of the fasteners. However, this is not intended to be limiting and is for illustrative purposes only. For example, it is envisaged that a single bump could be provided with a single seat cavity. Alternatively, a single bump may be provided with a plurality of seat cavities arranged along the length of the strips 221, 223 to provide a degree of adjustability to the fastener. Finally, a plurality of bumps, i.e. more than two, and a plurality of seat cavities could be provided if desired depending on the resistance to the release force required. Furthermore, it is envisaged that there may be a different number of cavities to bumps. For example, it is envisaged that there may be more cavities than bumps to allow the bump to be located in a different cavity thereby providing a degree of adjustability to the fastener.

As outlined above, throughout this specification the fasteners are described as being used between the back wings of a brassiere, and the terms "front" and "back" are used in that context (i.e. the front portion is that portion forwardmost on the wearer when the fastener is in use and the rear portion is that portion rearmost on the wearer when the fastener is in use). The invention however is not limited to such use or orientation and would also work well if reversed or applied to another application. For example, the present invention could be used as a front closure of a brassiere in which case the terms "front" and "back" would typically be reversed as that part of the fastener with the cavities would normally be located adjacent the body of the wearer and that portion of the fastener with the bumps would ordinarily be located on the far side of the part of the fastener with the cavities (i.e. the part with the bumps would be the part most remote from the wearer's body). Similarly, the fastener according to the invention could be used as a side fastener for a brassiere or instead of buttons or as an auxiliary fastener such as next to a zip on an item of clothing or piece of luggage.

In the embodiments described, reference is made to third, fourth and fifth catch faces however it will be understood that this is merely to identify the different catch faces and distinguish them from the other catch faces. For reasons of clarity, simply because reference or claim is made to a fifth catch face, this does not necessarily imply that there is a third and/or a fourth catch face and indeed there may only be the first, second and fifth catch faces in that circumstance unless otherwise specified.

In this specification the terms "comprise, comprises, comprised and comprising" and the terms Include, includes, included and including" are all deemed totally interchangeable and should be afforded the widest possible interpretation.

The invention is in no way limited to the embodiments hereinbefore described but may be varied in both construction and detail within the scope of the appended claims.

The invention claimed is:

1. A fastener for connecting together two pieces of which at least one is a textile, the fastener comprising:

a front element forming a backwardly open seat cavity, and having a pair of catch faces directed towards one end of the front element, flanking the seat cavity, and angled such that the front edges of the catch faces are further from the one end than the back edges of the catch faces;

a front magnet held in the front element immediately forward of the seat cavity;

a first tab extending from the one end of the front element and configured for connection to one of the pieces to exert traction on the front element and the front magnet in a direction towards the one end;

a back element formed with a forwardly projecting bump loosely fittable in the seat cavity, the back element having a pair of catch faces generally complementary to the catch faces of the front element and engageable therewith on engagement of the bump in the seat cavity;

a second tab extending from an end of the back element and configured for connection to the other of the pieces to exert traction on the back element away from the one end of the front element;

a back magnet secured in the bump, the front magnet and the back magnet being so polarized as to attract each other and pull the bump into the seat cavity on juxtaposition of the front and back elements;

and in which there is provided one or more pairs of catch faces selected from the group consisting of: an upwardly engagable catch face and an upwardly engagable complementary catch face; a downwardly engagable catch face and a downwardly engagable complementary catch face; and an opposingly engagable catch face and an opposingly engagable complementary catch face, wherein:

the upwardly engagable catch face is located on the front element directed substantially perpendicular to the one end of the front element, directed away from one side of the front element, and angled such that the front edge of the upwardly engagable catch face is closer to the side of the front element than the back edge of the upwardly engagable catch face and the upwardly engagable complementary catch face is located on the back element, engagable with the upwardly engagable catch face by urging the back element upwards relative to the front element, and configured to resist disengagement of the front element and the back element by upward misalignment of the back element relative to the front element;

the downwardly engagable catch face is located on the front element directed substantially perpendicular to the one end of the front element, directed towards the one side of the front element, and angled such that the front edge of the downwardly engagable catch face is further from that side of the front element than the back edge of the downwardly engagable catch face and the downwardly engagable complementary catch face is located on the back element, engagable with the downwardly engagable catch face by urging the back element downwards relative to the front element, and configured to resist disengagement of the front element and the back element by downward misalignment of the back element relative to the front element; and the opposingly engagable catch face is located on the front element directed away from the one end of the front element and angled such that the front edge of the opposingly engagable catch face is closer to the one end than the back edge of the opposingly engagable catch face and the opposingly engagable complementary catch face is located on the back element, engagable with the opposingly engagable catch face by urging the back element toward the one end of the front element, and configured to resist disengagement of the front element and the back element by misalignment of the back element relative to the front element in a direction opposite a normal wearing force.

2. The fastener as claimed in claim 1 in which two or more of the complementary catch faces on the back element are formed integrally with each other.

3. The fastener as claimed in claim 2 in which there are provided the upwardly engagable catch face and the upwardly engagable complementary catch face and the downwardly engagable catch face and the downwardly engagable complementary catch face, and wherein the upwardly engagable and downwardly engagable complementary catch faces on the back element are formed integrally with each other and with one of the pair of catch faces on the back element.

4. The fastener as claimed in claim 3 in which upwardly engagable and downwardly engagable complementary catch faces are joined by a column on the back element, and in which the seat cavity has an annular rim defining an open mouth, the annular rim having a channel formed therein for reception of the column.

5. The fastener as claimed in claim 1 in which the open seat cavity and the forwardly projecting bump are substantially triangular.

6. The fastener as claimed in claim 5 in which the corners of the substantially triangular open seat cavity and the forwardly projecting bump are rounded.

7. The fastener as claimed in claim 1 in which there are provided a plurality of rearwardly open seat cavities on the front element.

8. The fastener as claimed in claim 7 in which the plurality of rearwardly open seat cavities on the front element are connected together by way of a flexible substrate.

9. The fastener as claimed in claim 1 in which there are provided a plurality of forwardly projecting bumps on the back element.

10. The fastener as claimed in claim 9 in which the plurality of forwardly projecting bumps on the back element are mounted on a base plate thereby holding the forwardly projecting bumps in a fixed spaced relationship with respect to each other.

11. The fastener as claimed in claim 1 in which the number of rearwardly open seat cavities on the front element is greater than the number of forwardly projecting bumps on the back element.

12. The fastener as claimed in claim 1 in which there are provided the upwardly engagable catch face and the upwardly engagable complementary catch face, and wherein the upwardly engagable catch face is located internal the rearwardly open seat cavity.

13. The fastener as claimed in claim 1 in which there are provided the downwardly engagable catch face and the downwardly engagable complementary catch face, and wherein the downwardly engagable catch face is located internal the rearwardly open seat cavity.

14. The fastener as claimed in claim 1 in which there are provided the opposingly engagable catch face and the opposingly engagable complementary catch face, and wherein the opposingly engagable catch face is located internal the rearwardly open seat cavity.

15. The fastener as claimed in claim 1 in which of the upwardly engagable, downwardly engagable, and opposingly engagable catch faces and the upwardly engagable, downwardly engagable, and opposingly engagable complementary catch faces, there are provided only the upwardly engagable and downwardly engagable catch faces and the upwardly engagable and downwardly engagable complementary catch faces.

16. The fastener as claimed in claim 1 in which of the upwardly engagable, downwardly engagable, and opposingly engagable catch faces and the upwardly engagable, downwardly engagable, and opposingly engagable complementary catch faces, there is provided only the opposingly engagable catch face and the opposingly engagable complementary catch face.

17. The fastener as claimed in claim 1 in which there is provided all of the upwardly engagable, downwardly engagable, and opposingly engagable catch faces and the upwardly engagable, downwardly engagable, and opposingly engagable complementary catch faces.

18. A fastener for connecting together two pieces of which at least one is a textile, the fastener comprising:

a front element forming a backwardly open seat cavity, and having a pair of catch faces directed towards one end of the front element, flanking the seat cavity, and angled such that the front edges of the catch faces are further from the one end than the back edges of the catch faces;

a front magnet held in the front element immediately forward of the seat cavity;

a first tab extending from the one end of the front element and configured for connection to one of the pieces to exert traction on the front element and the front magnet in a direction towards the one end;

a back element formed with a forwardly projecting bump loosely fittable in the seat cavity, the back element having a pair of catch faces generally complementary to the catch faces of the front element and engageable therewith on engagement of the bump in the seat cavity;

a second tab extending from an end of the back element and configured for connection to the other of the pieces to exert traction on the back element away from the one end of the front element;

a back magnet secured in the bump, the front magnet and the back magnet being so polarized as to attract each other and pull the bump into the seat cavity on juxtaposition of the front and back elements;

and in which there is provided:

an upwardly engagable catch face on the front element directed substantially perpendicular to the one end of the front element, directed away from one side of the front element, and angled such that the front edge of the upwardly engagable catch face is closer to the side of the front element than the back edge of the third upwardly engagable catch face and an upwardly engagable complementary catch face on the back element, engagable with the upwardly engagable catch face by urging the back element upwards relative to the front element, and configured to resist disengagement of the front element and the back element by upward misalignment of the back element relative to the front element;

a downwardly engagable catch face on the front element directed substantially perpendicular to the one end of the front element, directed towards the one side of the front element, and angled such that the front edge of the downwardly engagable catch face is further from that side of the front element than the back edge of the downwardly engagable catch face and a downwardly engagable complementary catch face on the back element, engagable with the downwardly engagable catch face by urging the back element downwards relative to the front element, and configured to resist disengagement of the front element and the back element by downward misalignment of the back element relative to the front element.

19. A fastener for connecting together two pieces of which at least one is a textile, the fastener comprising:

a front element forming a backwardly open seat cavity, and having a pair of catch faces directed towards one end of the front element, flanking the seat cavity, and angled such that the front edges of the catch faces are further from the one end than the back edges of the catch faces;

a front magnet held in the front element immediately forward of the seat cavity;

a first tab extending from the one end of the front element and configured for connection to one of the pieces to exert traction on the front element and the front magnet in a direction towards the one end;

a back element formed with a forwardly projecting bump loosely fittable in the seat cavity, the back element having a pair of catch faces generally complementary to the catch faces of the front element and engageable therewith on engagement of the bump in the seat cavity;

a second tab extending from an end of the back element and configured for connection to the other of the pieces to exert traction on the back element away from the one end of the front element;

a back magnet secured in the bump, the front magnet and the back magnet being so polarized as to attract each other and pull the bump into the seat cavity on juxtaposition of the front and back elements;

and in which there is provided:

an opposingly engagable catch face on the front element directed away from the one end of the front element and angled such that the front edge of the opposingly engagable catch face is closer to the one end than the back edge of the opposingly engagable catch face and an opposingly engagable complementary catch face on the back element, engagable with the opposingly engagable catch face by urging the back element toward the one end of the front element, and configured to resist disengagement of the front element and the back element by misalignment of the back element relative to the front element in a direction opposite a normal wearing force.

* * * * *